US007249987B2

(12) United States Patent
Noda et al.

(10) Patent No.: US 7,249,987 B2
(45) Date of Patent: Jul. 31, 2007

(54) AIR INTAKE DEVICE FOR WATERCRAFT

(75) Inventors: Yoshiaki Noda, Saitama (JP); Masatsugu Matsumoto, Saitama (JP)

(73) Assignee: Honda Motor Co., Ltd., Toyko (JP)

( * ) Notice: Subject to any disclaimer, the term of this patent is extended or adjusted under 35 U.S.C. 154(b) by 0 days.

(21) Appl. No.: 11/387,935

(22) Filed: Mar. 24, 2006

(65) Prior Publication Data

US 2006/0223392 A1 Oct. 5, 2006

(30) Foreign Application Priority Data

Mar. 29, 2005 (JP) ..... 2005-095171

(51) Int. Cl.
*F02B 61/04* (2006.01)

(52) U.S. Cl. ..... 440/88 A; 114/55.5

(58) Field of Classification Search ..... None
See application file for complete search history.

(56) References Cited

U.S. PATENT DOCUMENTS 3,623,447 A * 11/1971 Jacobson ..... 440/88 A
6,761,601 B2 * 7/2004 Nakajima et al. ..... 440/88 A

FOREIGN PATENT DOCUMENTS

JP 2004-52681 A 2/2004

* cited by examiner

*Primary Examiner*—Lars A. Olson
(74) *Attorney, Agent, or Firm*—Birch, Stewart, Kolasch & Birch, LLP

(57) ABSTRACT

An air intake device for a watercraft adapted to suppress noise generating from an intake system of an engine and can obtain good intake efficiency. The air intake device includes intake ports opening to a side surface of the engine, and an air cleaner located on the rear side of the engine. An outlet of the air cleaner is connected through an intake passage to the intake ports of the engine. An air duct extends from an inlet of the air cleaner along the side surface of the engine to the position corresponding to the front end of the engine. The air duct has a front opening that faces downward.

20 Claims, 4 Drawing Sheets

AIR INTAKE DEVICE FOR WATERCRAFT

CROSS-REFERENCE TO RELATED APPLICATION

The present application claims priority under 35 U.S.C. §119 to Japanese Patent Application No. 2005-095171, filed Mar. 29, 2005, the entire contents of which are hereby incorporated by reference.

BACKGROUND OF THE INVENTION

1. Field of the Invention

The present invention relates to an improvement in an air intake device for an engine in a watercraft.

2. Description of Background Art

Conventionally known is an air intake structure for an engine in a compact water gliding boat having a boat body in which the engine is provided and an air cleaner located on the rear side of the engine (see for example Japanese Patent Laid-Open No. 2004-52681 (FIGS. 3 and 4)).

FIG. 3 in Japanese Patent Laid-Open No. 2004-52681 is a schematic view of an engine E as viewed from the right side of a compact water gliding boat (reference characters or numerals cited herein are those shown in this publication). The engine E has a cylinder block 12 and a crankcase 13 provided on the lower side of the cylinder block 12. A collector box 5 for temporarily storing the air fed from an air cleaner box 3 (see FIG. 4) and supplying the air to an intake pipe 6 is provided on one side of the crankcase 13.

FIG. 4 in Japanese Patent Laid-Open No. 2004-52681 is a plan view of the engine E shown in FIG. 3. The engine E includes the air cleaner box 3 having an outside air inlet member 31, located on the rear side of the cylinder block 12, a throttle body 4 located on the front side of the air cleaner box 3, and the collector box 5 located on the front side of the throttle body 4. The engine E further includes the intake pipe 6 provided so as to connect the collector box 5 and the engine E, and a fuel injection valve 61 mounted on the intake pipe 6.

The air introduced from the outside air inlet member 31 is supplied through the air cleaner box 3 and the throttle body 4 to the collector box 5. Thereafter, the air is supplied through the intake pipe 6, in which the air is mixed with a predetermined amount of fuel injected by the fuel injection valve 61 to form an air-fuel mixture, which is then supplied to the engine E.

However, the outside air inlet member 31 is located in the air cleaner box 3, so that the length of an air intake duct is short. Accordingly, there is little room of controlling the length of the air intake duct, and the flow of air in the air intake duct cannot be sufficiently straightened. Further, since the length of the air intake duct is short, noise from the engine easily leaks through the air intake duct.

Further, since the outside air inlet member 31 is located on the rear side of the cylinder block 12, the outside air inlet member 31 introduces the air passed along the side surface of the engine and therefore warmed by the heat from the engine. The higher the temperature of an intake air, the lower the intake efficiency of the engine, causing an adverse effect on the output from the engine.

SUMMARY AND OBJECTS OF THE INVENTION

It is accordingly an object of the present invention to provide an air intake device for a watercraft which can suppress noise generating from an intake system of an engine and can obtain good intake efficiency.

In accordance with a first aspect of the present invention, an air intake device is provided for a watercraft having a watercraft body composed of a hull forming a watercraft bottom and a deck covering the upper side of the hull, an engine provided in the watercraft body, and a saddle seat located on the upper side of the engine. In the air intake device, the engine has intake ports opening to a side surface of the engine; an air cleaner is located on the rear side of the engine; and an outlet of the air cleaner is connected through an intake passage to the intake ports of the engine. An air duct extends from an inlet of the air cleaner along the side surface of the engine to the position corresponding to the front end of the engine; and an outside air inlet unit is located on the front side of the engine in the watercraft body to supply an outside air to a front opening of the air duct. The outside air introduced from the outside air inlet unit into the watercraft body is supplied through the air duct to the air cleaner and subsequently supplied through the intake passage to the engine.

In accordance with a second aspect of the present invention, a flame arrester is provided in the air cleaner, and a throttle valve is provided adjacent to the outlet of the air cleaner.

In accordance with a third aspect of the present invention, the air duct is spaced apart from the watercraft bottom by a predetermined height, and the front opening of the air duct opens downward.

In accordance with a fourth aspect of the present invention, the engine is mounted in the watercraft body so that cylinders of the engine are arranged in a straight line extending in the longitudinal direction of the watercraft body; an exhaust pipe is arranged along one side of the engine so as to be connected to exhaust ports of the cylinders; and the air duct is arranged along the other side of the engine.

According to the first aspect of the present invention, the air cleaner is located on the rear side of the engine, and the air duct extends from the inlet of the air cleaner to the position corresponding to the front end of the engine. Further, the front opening for introducing the air into the air duct is formed at the front end of the air duct. Accordingly, the length of the air duct from the front opening to the inlet of the air cleaner can be increased. Owing to this increased length of the air duct, the leakage of noise from the intake system for the engine can be suppressed, and the flow of air in the air duct can also be straightened.

Furthermore, the outside air inlet unit is provided at the front portion of the watercraft body to supply the outside air to the front opening of the air duct. The outside air introduced from the outside air inlet unit into the watercraft body is supplied to the front opening of the air duct, then flowing in the air duct toward the air cleaner. Accordingly, cool air can be supplied to the engine, so that the intake efficiency of the engine can be improved.

Further, there is a case that the engine or a part of the engine accessories are accommodated under the seat, so as to air at a size reduction of this kind of watercraft. If the air cleaner is located above the engine in this case, the height of the seat is influenced. Further, if the air cleaner is located on one side of the engine in this case, the width of the seat must be increased.

In this respect, the air cleaner is located on the rear side of the engine according to the present invention, thereby allowing proper control of the height or width of the seat.

According to the second aspect of the present invention, the flame arrester is provided in the air cleaner, and the throttle valve is provided adjacent to the outlet of the air cleaner. Accordingly, the throttle valve and the flame arrester can be located close to each other, thereby enhancing the effect of the flame arrester.

According to the third aspect of the present invention, the front opening formed at the front end of the air duct opens downward. Accordingly, the entry of water into the air duct can be prevented.

Further, since the air duct is spaced apart from the watercraft bottom by a predetermined height, the entry of water into the air duct can be prevented to maintain good intake performance.

According to the fourth aspect of the present invention, the exhaust pipe connected to the exhaust ports of the cylinders is arranged along one side of the engine, and the air duct is arranged along the other side of the engine. Accordingly, there is no possibility that the intake air may be warmed by the heat from the exhaust system.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
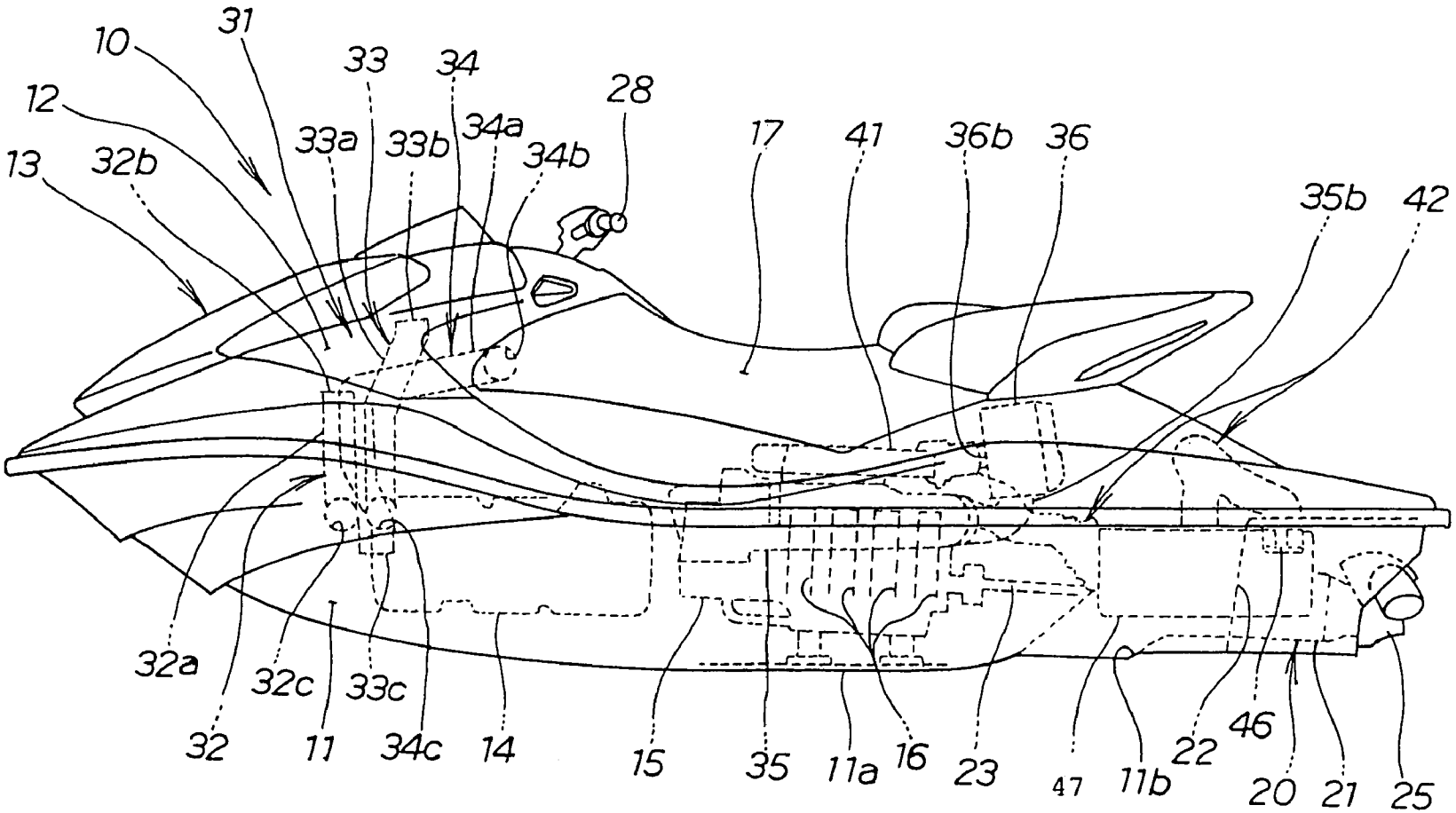
FIG. 1 is a side view of a watercraft according to the present invention.

FIG. 1 is a side view of a watercraft according to the present invention.

The watercraft 10 (which will be hereinafter referred to also as jet propulsion boat 10) has a watercraft body 13 composed of a hull 11 forming a watercraft bottom 11*a* (which will be hereinafter referred to also as boat bottom 11*a*) and a deck 12 covering the upper side of the hull 11. A fuel tank 14 is provided in the watercraft body 13, and an engine 15 is located on the rear side of the fuel tank 14. A saddle seat 17 is located on the upper side of the engine 15, and a jet pump 20 is located on the rear side of the engine 15. A steering handle 28 is located on the upper side of the fuel tank 14.

The engine 15 has four cylinders 16 formed substantially upright and arranged in a straight line extending in the longitudinal direction of the watercraft body 13.

The jet pump 20 has a pump housing 21 extending rearward from an opening 11*b* of the boat bottom 11*a* constituting the hull 11. An impeller (not shown) is rotatably mounted in the pump housing 21. The impeller is connected to a drive shaft 23 of the engine 15.

Thus, the engine 15 is driven to rotate the impeller in the jet pump 20, thereby sucking water from the opening 11*b* of the boat bottom 11*a*. The water thus sucked into the pump housing 21 is jetted from a steering nozzle 25. Reference numeral 22 denotes a jet pump chamber containing the jet pump 20.

The steering nozzle 25 is mounted at the rear end of the pump housing 21 so as to be swingable in the lateral direction of the watercraft body 13. The steering nozzle 25 is swung by the operation of the steering handle 28, thereby controlling a steering direction of the watercraft body 13.

Thus, the jet propulsion boat 10 is a kind of watercraft capable of gliding on the surface of water by supplying fuel from the fuel tank 14 to the engine 15 to drive the engine 15, transmitting a drive force of the engine 15 through the drive shaft 23 to the jet pump 20 to drive the jet pump 20, thereby sucking water from the opening 11*b* of the boat bottom 11*a* into the pump housing 21, and jetting the sucked water from the steering nozzle 25 provided at the rear end of the pump housing 21.

The engine 15 is provided with an air intake system having the following configuration.

An outside air inlet unit 31 for introducing the outside air into the watercraft body 13 is provided at a front portion of the watercraft body 13. The outside air inlet unit 31 includes three outside air inlet ducts 32, 33, and 34.

The outside air inlet duct 32 is composed of a tubular portion 32*a*, an outer opening 32*b* formed at one end of the tubular portion 32*a*, and an inner opening 32*c* formed at the other end of the tubular portion 32*a*. The outer opening 32*b* is located at an upper position in the watercraft body 13, and the inner opening 32*c* is located at a lower position in the watercraft body 13.

Similarly, the outside air inlet duct 33 is composed of a tubular portion 33*a*, an outer opening 33*b* formed at one end of the tubular portion 33*a*, and an inner opening 33*c* formed at the other end of the tubular portion 33*a*. Similarly, the outside air inlet duct 34 is composed of a tubular portion 34*a*, an outer opening 34*b* formed at one end of the tubular portion 34*a*, and an inner opening 34*c* formed at the other end of the tubular portion 34*a*.

To supply the air introduced by the outside air inlet ducts 32, 33, and 34 to the engine 15, an air duct 35 is provided along the engine 15 on one side thereof, and an air cleaner 36 for cleaning the air to be supplied to the engine 15 is connected to a rear end 35*b* of the air duct 35. Further, an intake passage 41 for introducing the clean air from an outlet 36*b* of the air cleaner 36 to the engine 15 is provided along the engine 15 on the front side of the air cleaner 36.

As described above, the outside air inlet ducts 32, 33, and 34 are provided at the front portion of the watercraft body 13. Accordingly, a necessary and sufficient amount of air can be introduced into the watercraft body 13.

As described later, a throttle valve and a fuel injection valve are interposed between the air cleaner 36 and the engine 15.

The engine 15 is provided with an exhaust system including an exhaust pipe 42 for conveying exhaust gases from the engine 15 to the outside of the watercraft body 13. The exhaust pipe 42 extends from the other side of the engine 15 toward the rear side thereof. An open/close valve 46 is provided at an outlet of the exhaust pipe 42, and a water muffler 47 is provided in the middle of the exhaust pipe 42.

Figure 2:
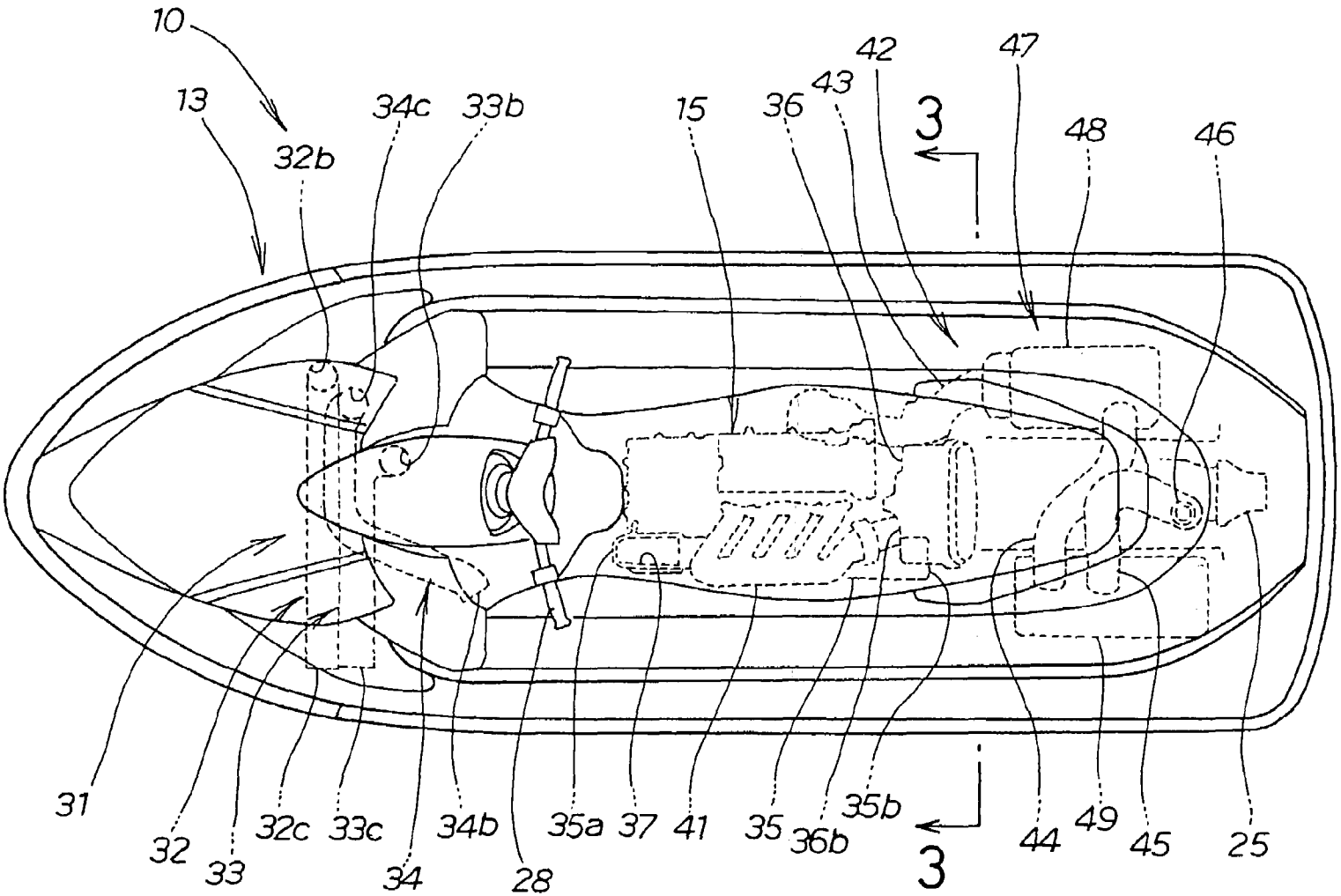
FIG. 2 is a plan view of the watercraft according to the present invention.

FIG. 2 is a plan view of the watercraft 10 according to the present invention.

The air intake system for the engine will now be described in more detail.

The engine 15 is located at a substantially central position in the watercraft body 13. The outside air inlet ducts 32, 33, and 34 constituting the outside air inlet unit 31 for introducing the outside air into the watercraft body 13 are located on the front side of the engine 15. The outside air inlet ducts 32, 33, and 34 have the outer openings 32*b*, 33*b*, and 34*b* and the inner openings 32*c*, 33*c*, and 34*c*, respectively. The air duct 35 is located on the rear side of the inner openings 32*c*, 33*c*, and 34*c* of the outside air inlet ducts 32, 33, and 34.

The air duct 35 extends along the left side of the engine 15, and has a front end 35*a* formed with a front opening 37. The air cleaner 36 is connected to the rear end 35*b* of the air duct 35. The intake passage 41 is connected between the outlet 36*b* of the air cleaner 36 and the engine 15.

Thus, the air intake system for the engine 15 includes the outside air inlet unit 31 located on the front side of the engine 15 in the watercraft body 13 to supply the outside air to the front opening 37 of the air duct 35. The outside air thus introduced from the outside air inlet unit 31 into the watercraft body 13 is supplied through the air duct 35 to the air cleaner 36. Thereafter, the clean air from the outlet 36*b* of the air cleaner 36 is supplied through the intake passage 41 to the engine 15.

The exhaust system for the engine 15 will now be described in more detail.

The exhaust system includes the exhaust pipe 42 for conveying exhaust gases from the engine 15 to the outside of the watercraft body 13. The exhaust pipe 42 is composed of a first exhaust pipe 43, a second exhaust pipe 44, and a third exhaust pipe 45. Thus, the first, second, and third exhaust pipes 43, 44, and 45 are connected together in this order along the direction of flow of the exhaust gases. The open/close valve 46 is mounted at the outlet of the third exhaust pipe 45. Further, a first water muffler 48 is interposed between the first exhaust pipe 43 and the second exhaust pipe 44 and a second water muffler 49 is interposed between the second exhaust pipe 44 and the third exhaust pipe 45.

Thus, the exhaust system includes the exhaust pipe 42 for conveying exhaust gases from the engine 15 to the outside, the open/close valve 46 mounted at the outlet of the exhaust pipe 42, and the water muffler 47, composed of the first muffler 48 and second muffler 49, provided in the middle of the exhaust pipe 42 for reducing exhaust noise and conveying exhaust gases from the engine 15.

Figure 3:
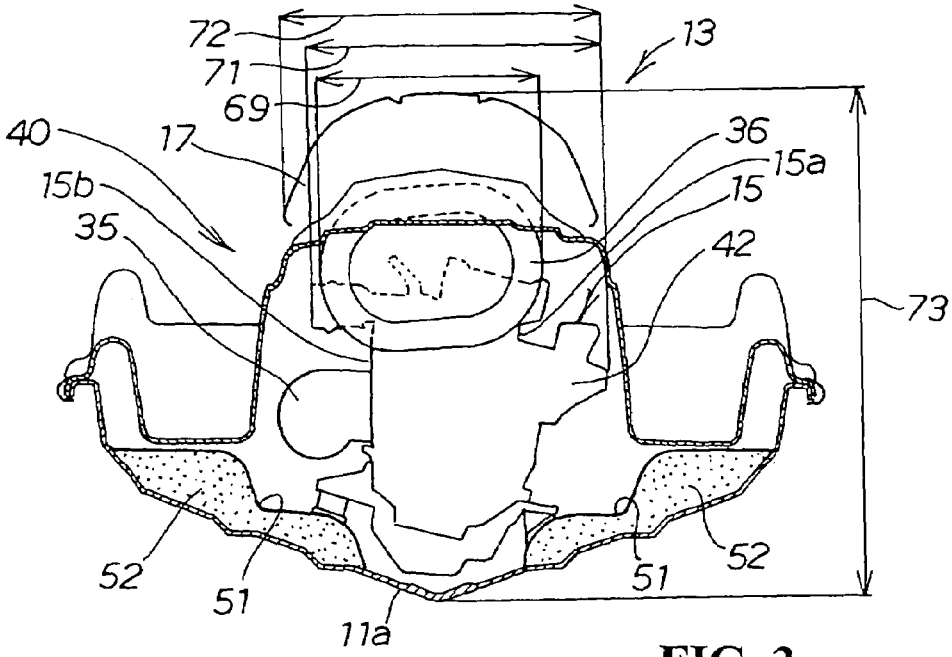
FIG. 3 is a cross section taken along the line 3—3 in FIG. 2.

FIG. 3 is a cross section taken along the line 3—3 in FIG. 2. As shown in FIG. 3, an inner bottom 51 is provided on the boat bottom 11*a*, and the engine 15 is mounted on the inner bottom 51. The air cleaner 36 is mounted on the rear end of the engine 15, and the air duct 35 is mounted on the left side of the engine 15. Reference numeral 52 denotes a foamed member filling the space defined between the boat bottom 11*a* and the inner bottom 51 so as to soften the vibration of the watercraft body 13.

The air duct 35 is spaced apart from the boat bottom 11*a* by a predetermined height. Accordingly, the entry of water into the air duct 35 can be prevented to thereby maintain good intake performance.

The engine 15 is mounted in the watercraft body 13 so that the four cylinders 16 (see FIG. 1) are arranged in a straight line extending in the longitudinal direction of the watercraft body 13. The exhaust pipe 42 is arranged along one side 15*a* of the engine 15 so as to be connected to the exhaust ports of the cylinders 16, and the air duct 35 is arranged along the other side 15*b* of the engine 15.

Thus, the exhaust pipe 42 connected to the exhaust ports of the cylinders 16 is arranged along one side 15*a* of the engine, and the air duct 35 is arranged along the other side 15*b* of the engine. Accordingly, there is no possibility that the intake air may be warmed by the heat from the exhaust system.

Figure 4:
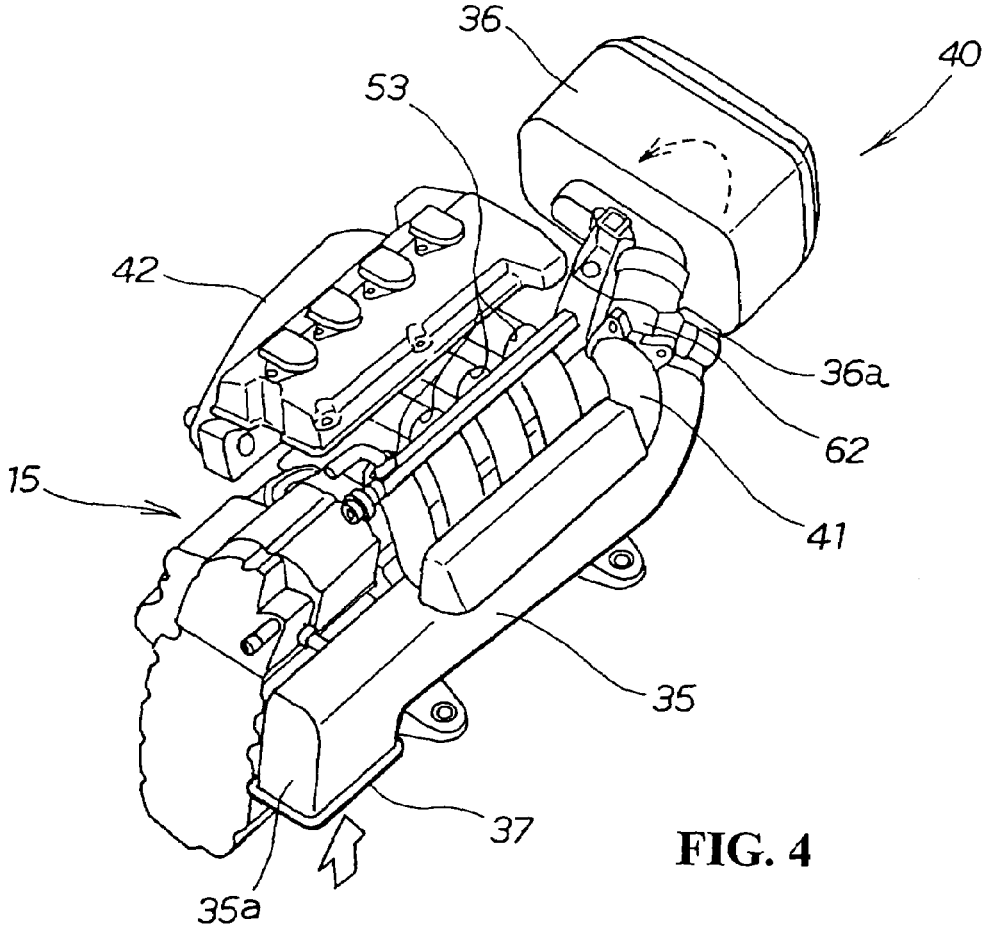
FIG. 4 is a perspective view of an engine provided with an air intake device according to the present invention.

FIG. 4 is a perspective view of the engine provided with an air intake device according to the present invention. The air intake device 40 includes the air duct 35 and the air cleaner 36 mounted on the engine 15.

The engine 15 has intake ports 53 opening to the side surface of the engine 15. The air cleaner 36 is located on the rear side of the engine 15. The outlet of the air cleaner 36 is connected through the intake passage 41 to the intake ports of the engine 15. The air duct 35 extends from the inlet 36*a* of the air cleaner along the side of the engine 15 to the position corresponding to the front end of the engine 15. The air duct 35 is spaced apart from the boat bottom 11*a* by a predetermined height. The front opening 37 of the air duct 35 opens downward.

Thus, the front opening 37 formed at the front end 35*a* of the air duct 35 opens downward. Accordingly, it is possible to prevent a problem such that water due to sea spray, for example, may enter the air duct 35. As compared with the case where the front opening 37 opens sideward or upward, the entry of water into the air duct 35 can be effectively prevented.

Figure 5:
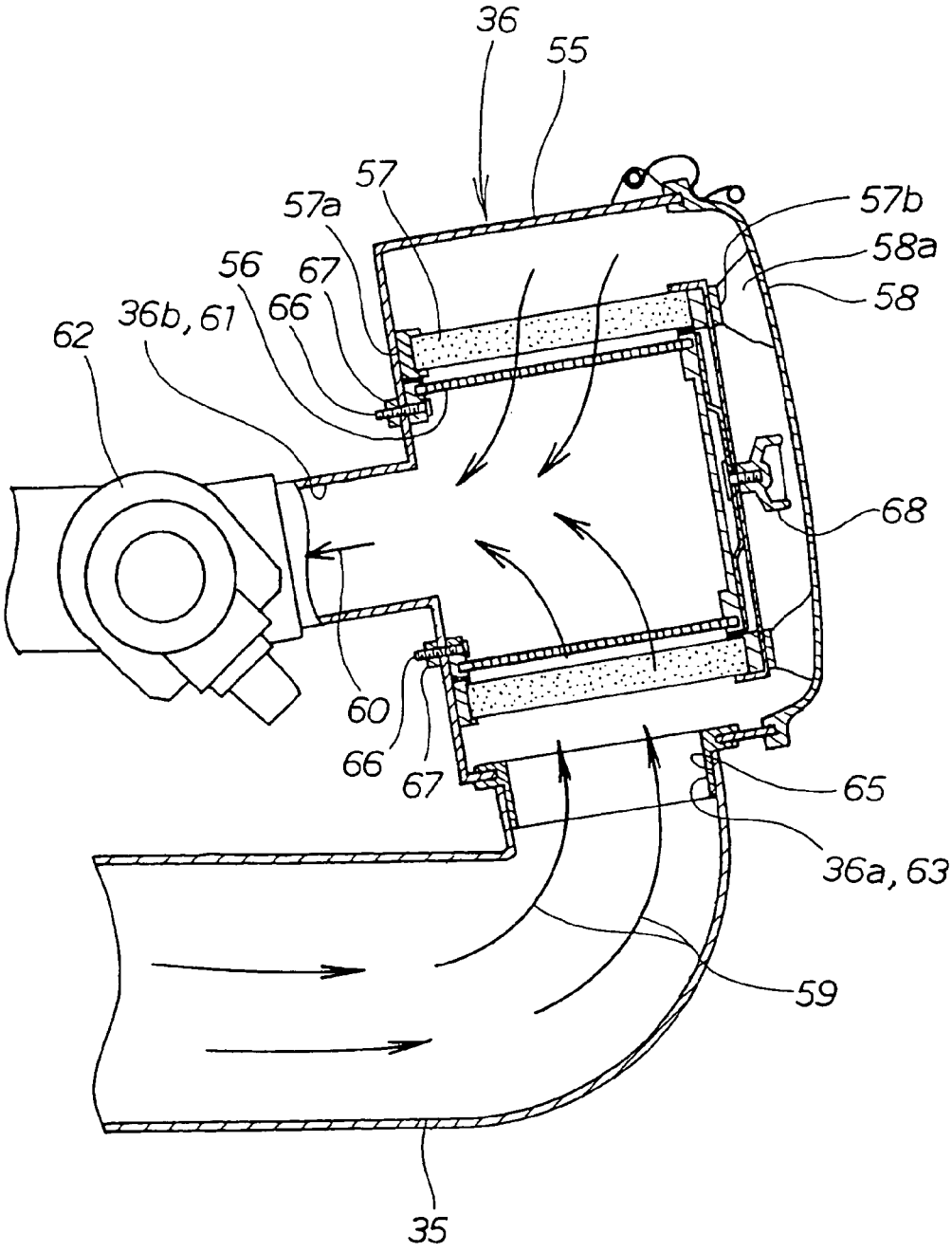
FIG. 5 is a sectional view of an air cleaner according to the present invention, showing the arrangement of the air cleaner, an air duct, and a throttle valve.

FIG. 5 is a sectional view of the air cleaner according to the present invention, showing the arrangement of the air duct, the air cleaner, and a throttle valve.

The air cleaner 36 is composed of a case 55, a cylindrical flame arrester 56 mounted inside of the case 55, a cylindrical filter 57 arranged so as to surround the flame arrester 56, and a lid 58 for covering the case 55. The case 55 has a substantially central air outlet 61, and the throttle valve 62 is provided adjacent to the air outlet 61. The case 55 is provided at its lower portion with an air inlet member 63, and an outlet 65 of the air duct 35 is connected to the air inlet member 63.

Thus, the flame arrester 56 is provided inside of the air cleaner 36, and the throttle valve 62 is adjacent to the air outlet 61 (the outlet 36*b*) of the air cleaner. The flame arrester 56 is formed from a wire net, for example.

The flame arrester 56 is fixed to the case 55 by bolts 66 and nuts 67.

The filter 57 is mounted in the case 55 in the following manner. First, the filter 57 is inserted into the case 55 until one end surface 57*a* of the filter 57 abuts against the case 55. Thereafter, the filter 57 is mounted to the flame arrester 56 by a nut 68. Finally, the other end surface 57*b* of the filter is held by a hold member 58*a* extends from the lid 58 so as to mount the filter 57 to the case 55.

The filter 57 can be removed from the case 55 by first removing the lid 58 and next removing the nut 68. Thus, the filter 57 is removably mounted in the case 55, thereby ensuring good maintainability.

As mentioned above, the flame arrester 56 is provided inside of the air cleaner 36, and the throttle valve 62 is provided adjacent to the outlet 36*b* of the air cleaner. Accordingly, the throttle valve 62 can be located close to the flame arrester 56.

With this arrangement that the throttle valve 62 is located close to the flame arrester 56, the effect of the flame arrester 56 can be enhanced.

The air flowing in the air duct 35 enters the air cleaner 36 from the air inlet member 63 as shown by arrows 59. Thereafter, the air is passed through the filter 57 and the flame arrester 56, and flows out from the air outlet 61 toward the throttle valve 62 provided to the front portion of the air cleaner 36 as shown by an arrow 60.

The operation of the present invention will now be described with reference to FIG. 2.

As described above, the air cleaner 36 is located on the rear side of the engine 15, and the air duct 35 extends from the inlet of the air cleaner 36 along the side of the engine 15 to the position corresponding to the front end of the engine 15. Further, the front opening 37 for introducing the air is formed at the front end. Accordingly, the length of the air duct 35 from the front opening 37 to the inlet of the air cleaner 36 can be increased. Owing to this increased length of the air duct 35, the leakage of noise from the intake system for the engine 15 can be suppressed, and the flow of air in the air duct 35 can also be straightened.

Furthermore, the outside air inlet unit 31 is provided at the front portion of the watercraft body 13 to supply the outside air to the front opening 37 of the air duct 35. The outside air introduced from the outside air inlet unit 31 into the watercraft body 13 is supplied to the front opening 37 of the air duct 35, then flowing in the air duct 35 toward the air cleaner 36. Accordingly, cool air can be supplied to the engine 15, so that the intake efficiency of the engine 15 can be improved.

As shown in FIG. 3, the air cleaner 36 is located on the rear side of the engine 15, more specifically, directly behind the rear end of the engine 15. Further, the width 69 of the air cleaner 36 is set smaller than the width 71 of the engine 15. Accordingly, the air cleaner 36 can be located within the width 71 of the engine 15. As a result, the width 72 or height 73 of the seat 17 can be suppressed.

In the case that the air cleaner 36 is located on one side of the engine 15 or above the engine 15, there is a possibility that the width 72 or height 73 of the seat 17 may be increased to accommodate the air cleaner 36 within the watercraft body. With the arrangement that the air cleaner 36 is located directly behind the rear end of the engine 15, the above-mentioned possibility can be eliminated and the width of the watercraft body 13 can also be reduced.

The present invention is suitable for a jet propulsion boat.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air intake device for a watercraft having a watercraft body composed of a hull forming a watercraft bottom and a deck covering the upper side of said hull, an engine provided in said watercraft body, and a saddle seat located on the upper side of said engine, wherein:

said engine has intake ports opening to a side surface of said engine, an air cleaner is located on the rear side of said engine, and an outlet of said air cleaner is connected through an intake passage to said intake ports of said engine;

an air duct extends from an inlet of said air cleaner along the side surface of said engine to the position corresponding to the front end of said engine, and an outside air inlet unit is located on the front side of said engine in said watercraft body to supply an outside air to a front opening of said air duct;

whereby the outside air introduced from said outside air inlet unit into said watercraft body is supplied through said air duct to said air cleaner and subsequently supplied through said intake passage to said engine.

2. The air intake device according to claim 1, wherein a flame arrester is provided in said air cleaner, and a throttle valve is provided adjacent to said outlet of said air cleaner.

3. The air intake device according to claim 1, wherein said air duct is spaced apart from said watercraft bottom by a predetermined height, and said front opening of said air duct opens downward.

4. The air intake device according to claim 1, wherein said engine is mounted in said watercraft body so that cylinders of said engine are arranged in a straight line extending in the longitudinal direction of said watercraft body, an exhaust pipe is arranged along one side of said engine so as to be connected to exhaust ports of said cylinders, and said air duct is arranged along the other side of said engine.

5. The air intake device according to claim 1, wherein the outside air inlet unit includes three outside air inlet ducts.

6. The air intake device according to claim 5, wherein each of the three outside air inlet ducts includes a tubular portion, an outer opening formed at one end of the tubular portion, and an inner opening formed at the other end of the tubular portion.

7. The air intake device according to claim 1, wherein an air inlet member is provided on a lower side of the air cleaner and an air outlet is provided on a forward side of the air cleaner, wherein the air duct is connected to the air inlet member, and a throttle valve is provided adjacent to the air outlet.

8. The air intake device according to claim 1, wherein a width of the air cleaner is set smaller than a width of the engine, and the width of the engine is smaller than a width of the saddle seat.

9. The air intake device according to claim 1, wherein the intake passage is disposed above the air duct.

10. The air intake device according to claim 1, wherein the air in the air duct flows in a rearward direction, and after passing through the air cleaner, the air in the intake passage flows in a forward direction.

11. An air intake device for a watercraft having a watercraft body composed of a hull forming a watercraft bottom and a deck covering the upper side of said hull, an engine provided in said watercraft body, and a saddle seat located on the upper side of said engine, comprising:

intake ports opening to a side surface of the engine;

an air cleaner located on the rear side of the engine, an outlet of the air cleaner being connected through an intake passage to the intake ports of the engine;

an air duct extending from an inlet of the air cleaner along the side surface of said engine to the position corresponding to the front end of the engine; and an outside air inlet unit located on the front side of the engine in the watercraft body to supply an outside air to a front opening of said air duct, whereby the outside air introduced from the outside air inlet unit into the watercraft body is supplied through the air duct to the air cleaner and subsequently supplied through the intake passage to the engine, wherein the air passage overlaps a portion of a length of the air duct.

12. The air intake device according to claim 11, wherein a flame arrester is provided in said air cleaner, and a throttle valve is provided adjacent to the outlet of the air cleaner.

13. The air intake device according to claim 11, wherein the air duct is spaced apart from the watercraft bottom by a predetermined height, and the front opening of the air duct opens downward.

14. The air intake device according to claim 11, wherein the engine is mounted in the watercraft body so that cylinders of the engine are arranged in a straight line extending in the longitudinal direction of the watercraft body, an exhaust pipe is arranged along one side of the engine so as to be connected to exhaust ports of the cylinders, and the air duct is arranged along the other side of the engine.

15. The air intake device according to claim 11, wherein the outside air inlet unit includes three outside air inlet ducts.

16. The air intake device according to claim 15, wherein each of the three outside air inlet ducts includes a tubular portion, an outer opening formed at one end of the tubular portion, and an inner opening formed at the other end of the tubular portion.

17. The air intake device according to claim 11, wherein an air inlet member is provided on a lower side of the air cleaner and an air outlet is provided on a forward side of the air cleaner, wherein the air duct is connected to the air inlet member, and a throttle valve is provided adjacent to the air outlet.

18. The air intake device according to claim 11, wherein a width of the air cleaner is set smaller than a width of the engine, and the width of the engine is smaller than a width of the saddle seat.

19. The air intake device according to claim 11, wherein the intake passage is disposed above the air duct.

20. The air intake device according to claim 11, wherein the air in the air duct flows in a rearward direction, and after passing through the air cleaner, the air in the intake passage flows in a forward direction.

* * * * *